United States Patent [19]

Townsend

[11] Patent Number: 4,698,921

[45] Date of Patent: Oct. 13, 1987

[54] SHOE TABS FOR CHAINS

[76] Inventor: Blue H. Townsend, 141 Ramblewood Dr., Bartlesville, Okla. 74003

[21] Appl. No.: 911,742

[22] Filed: Sep. 26, 1986

[51] Int. Cl.[4] ..... A43C 15/00; A43C 15/06; A43C 1/00

[52] U.S. Cl. ..... 36/62; 36/136; 24/140

[58] Field of Search ..... 36/62, 50, 132, 136, 36/66, 64, 65, 61; 24/140, 141, 142

[56] References Cited

U.S. PATENT DOCUMENTS

| | | | |
|---|---|---|---|
| 257,750 | 5/1882 | Parcelle | 24/141 |
| 317,526 | 5/1885 | Fenton | 24/140 |
| 571,670 | 11/1896 | Kollock | 24/141 |
| 1,057,382 | 3/1913 | Kramer | 24/140 |
| 1,058,343 | 4/1913 | Bacon, Jr. | 36/62 |
| 1,437,258 | 11/1922 | Miller | 36/62 |
| 1,492,513 | 4/1924 | Groebl | 36/62 |
| 1,508,214 | 9/1924 | Brown | 36/62 |
| 1,607,450 | 11/1926 | Eubank | 36/62 |
| 1,982,510 | 11/1934 | Frazey | 36/62 |
| 3,949,495 | 4/1976 | Hollmann | 36/62 |

FOREIGN PATENT DOCUMENTS

| | | | |
|---|---|---|---|
| 498262 | 2/1928 | Fed. Rep. of Germany | 36/62 |
| 501374 | 11/1954 | Italy | 24/140 |
| 300454 | 11/1928 | United Kingdom | 36/62 |

*Primary Examiner*—Ronald Feldbaum
*Assistant Examiner*—Steven N. Meyers
*Attorney, Agent, or Firm*—Head & Johnson

[57] ABSTRACT

This is a leather shoe tab for sewing on both the inside and outside of the vamp or quarter of a boot. The tab has one or more parallel essentially straight sided U-shaped cuts along the interior of the tab and completely therethrough. This makes one or more fingers and each finger has one or more eyelets therein. The ends of the finger having the eyelets can be pulled away from the plane of the tab so that hooks on ice chains can be placed therethrough, thus forming ice resistance chains across the sole.

7 Claims, 6 Drawing Figures

SHOE TABS FOR CHAINS

BACKGROUND OF THE INVENTION

1. Field of the Invention

This invention relates to an anti-skidding device for use with footwear such as hiking boots and the like.

2. Background of the Prior Art

Man has been slipping and sliding on the ground during icy conditions or in certain conditions where it is wet and muddy for ages. Numerous types of antislipping devices for shoes have been devised in the prior art, each intended to provide as a principal objective the preventing of one slipping upon the ice. Many of these provide various means for holding chains across the soles or heels of shoes or boots for the purpose of obtaining traction. For various reasons none of the prior art anti-slipping devices has really caught on and people continue to slide and slip on ice and even injure themselves and occasionally even receive brain concussions.

Some of these anti-slipping devices are various means of using strapping to hold the chains in position across the sole or heel. Patents showing various ways of doing this include: U.S. Pat. Nos. 1,492,513; 1,508,214; 2,065,727; 1,607,450; 3,583,083; and 3,949,495. Other anti-slipping devices are rather complex and of expensive construction and require in most instances modification or cutting holes into the shoe itself. One such device is U.S. Pat. No. 1,437,258 in which a hole is cut in the side of a shoe and a socket inserted therein for connecting chains. The cutting of the hole invariable affects the integrity of the boot. Such sockets do not go with the usual decor of boots.

Further, the socket shown in U.S. Pat. No. 1,437,258 would easily collect trash when walking through underbrush inasmuch as the projections are not even close to being flush with the shoe.

It is therefore an object of this invention to provide an anti-slipping device for boots which does not depend upon straps and does not affect the integrity of the boot.

SUMMARY OF THE INVENTION

Novel tabs are provided to be sewn on the inside and outside of vamps and quarter of boots. These tabs are sewn on to the outside of the boot and thus do not compromise the integrity of the construction of the boot. A typical tab according to my invention is made of the same material, usually leather, as the boot is. The tab is a flat rectangularly shaped piece of leather. It has one or two U-cuts on the interior there in which the U is composed of three straight lines and the two upright sides of the U are preferably essentially parallel to the sides of the tab. These cuts form fingers and the lower portion of the finger is provided with eyelets on opposite sides of the boot through which hooks on chains can be secured and extend across the soles and/or heels. The upper portion of these fingers are still integral with the flat piece of leather and the lower side is held flush with the tab in normal wear. Whenever it becomes desired to convert the boot into an anti-slipping device, all one has to do is to lift out of the fingers slightly so that the hooks of the ends of chains can be connected into the eyelets and then the chain is held securely across the sole of the foot and/or across the heel.

DESCRIPTION OF THE PREFERRED EMBODIMENTS

Figure 1:
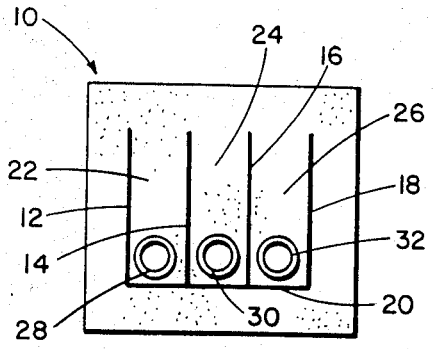
FIG. 1 shows an Ice Creeper TM tab featuring three fingers with eyelets.

Attention is first directed to FIG. 1 which shows the Ice Creeper TM tab 10 having four parallel straight line cuts 12, 14, 16, 18 and a single straight line cut 20 which connects the lower ends of the cuts 12, 14, 16 and 18. This forms fingers 22, 24 and 26 and a corresponding finger surrounding portion. These fingers are all integral with the leather tab at the top. Each finger is thus formed by three cuts which are essentially in the shape of a straight-sided U. Eyelets 28, 38 and 32 are provided in the lower ends of fingers 22, 24 and 26. It is through these eyelets that hooks of chains for strapping across the sole of the boot are anchored.

Figure 2:
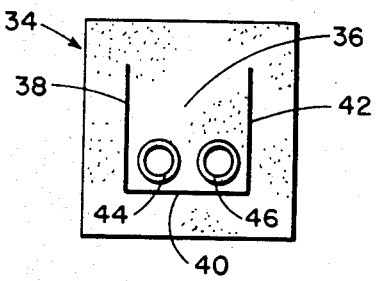
FIG. 2 features an Ice Creeper TM tab with one finger having two eyelets.

FIG. 2 shows a slightly different Ice Creeper TM tab 34 having a single finger 36 formed by cuts 38, 40 and 42. While these lines in the U shape cut are not required to be straight, it is preferred that they are. Here in this case in FIG. 2 finger 36 has eyelets 44 and 46.

Figure 3:
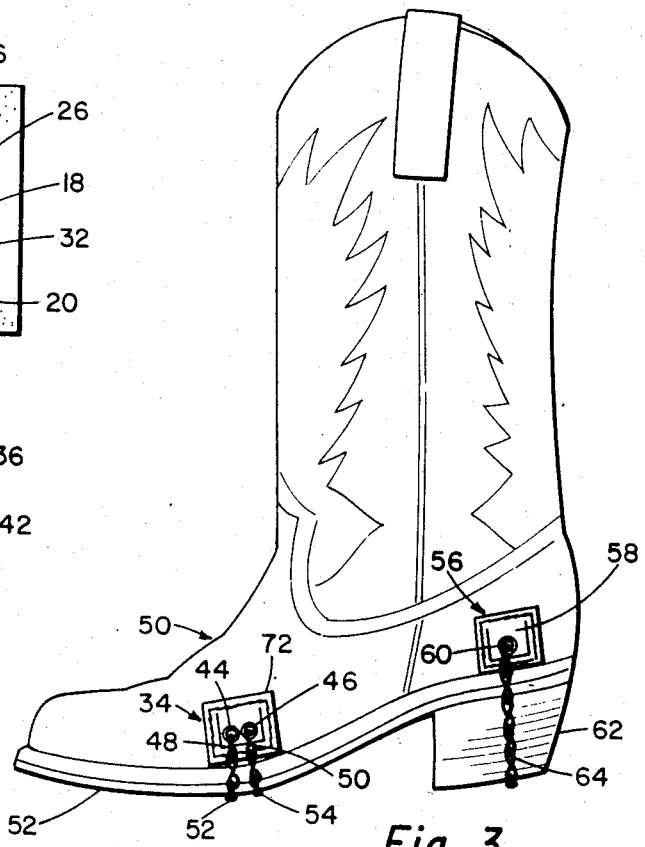
FIG. 3 illustrates tabs sewn onto a boot.
Figure 4:
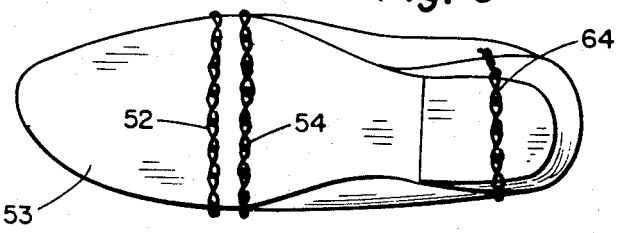
FIG. 4 shows the sole of the boot of FIG. 3 with ice resistant chains attached.

Attention is next directed to FIG. 3 which shows boot 50 with a tab 34 sewn on the vamp thereof so that the bottom edge of the tab is adjacent the sole 52. Chains 52 and 54 are provided with hooks 48 and 50, respectively, which connect through eyelets 44 and 46 of the tab 34. There is a similar Ice Creeper TM tab on the medial side of the boot and the other ends of chains 52 and 54 are also provided with hooks which are secured to eyelets in the tab on the lateral side. Tabs 56 having a finger 58 and eyelet 60 are secured to the quarter of the boot just above heel 62. A chain 64 is secured to eyelet 60 on either side of the boot similarly as chains 52 and 54. FIG. 4 shows the bottom of sole 53 showing chains 52 and 54 across the sole and chain 64 across the bottom of the heel of the boot. This gives the wearer of the boot exceptionally good footing when walking on ice.

Figure 5:
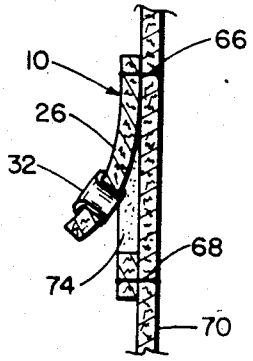
FIG. 5 shows a sectional view of my pad sewn to the leather of a boot.

Attention is now directed to FIG. 5 which shows a view through one of the fingers such as finger 26 having eyelet 32 in tab 10. The tab 10 is sewn at 66 and 68 to the leather or material 70 of the vamp of boot 50. It is preferred that the tab 10 be of the same material as the shoe or boot to which it is to be attached. Inasmuch as most quality boots are made of leather, then the tab 10 would be of matching leather to improve its eye appeal. The stitching 66 and 68 really extends around the tab as indicated at lines 72 in FIG. 3. The cuts 12, 14, 16, 18 and 20 are all fine narrow cuts so that the fingers 26 will stay in the same general planar configuration as the tab 10 before the cuts were made. After the tabs are sewn or otherwise secured to the boot, they will normally stay such that the fingers are flush against the vamp 68. When it is desired to secure the chains to the boot, one pulls out the finger such as 26 shown in FIG. 5 and slips a hook through eyelet 32. It is clear from the view of FIG. 5 that the integrity of the boot has not been breached. The only thing which has been added to the leather by securing these tabs thereto is the stitchings. Most boots are put together by stitching. This stitching can only add to the value of the boot.

When the chains are secured as shown in FIGS. 3 and 4, one can walk quite well upon even the slickests of ice surfaces. When one gets through walking on such surfaces, the chains 52, 54, 64 are readily removed by removing the hooks from eyelets of the tab such as eyelets 32. The fingers such as 26 are then shoved back into the space in which they came so that they again present a flat surface, that is, the finger 26 as shown in FIG. 5 is pushed back into cavity 74.

Figure 6:
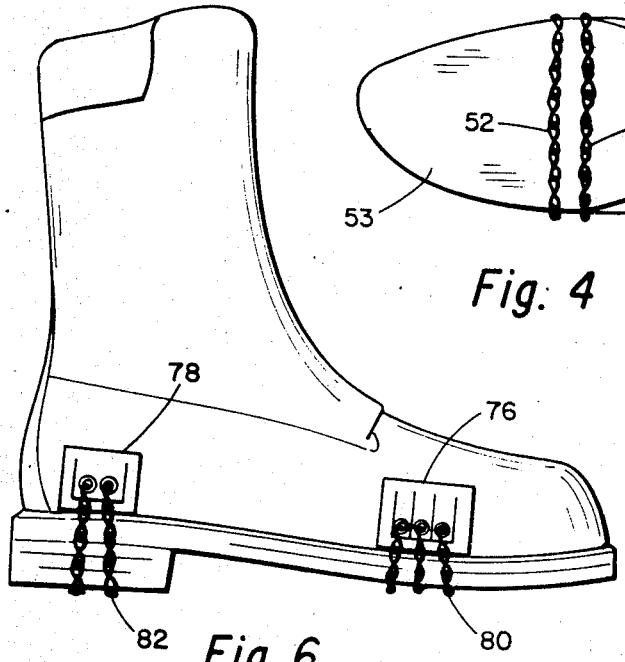
FIG. 6 is similar to FIG. 3 except it shows a different type boot and shows tabs having a different number of fingers.

Attention is now directed to FIG. 6 which shows a different type boot upon which my Ice Creeper TM that can be attached. Shown thereon are tabs 76 on the vamps and 78 at the heel. The heel tab 78 is essentially the same as that shown in FIG. 2 and the vamp tab 76 is essentially the same as shown in FIG. 1. Chains 80 and 82 connect eyelets of tabs 76 and 78 on opposite sides of the boot similarly as that described in regard to FIGS. 3 and 4. When the chains are not in the eyelets of my tabs the tab fingers are flush with the tab and would not tend to collect trash from walking through the underbrush.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A boot adaptable for walking on a slippery surface which comprises:

a vamp having a medial and a lateral;

a first and second tab secured to the left and right sides of said vamp, each said tab comprising a single piece of material having cuts made therethrough but none to the periphery thereof for creating at least one finger and a corresponding finger surrounding portion in each tab, in which one end of the finger is integral with the material and the other end is movable with respect to the finger surrounding portion of the tab and an eyelet in each such movable end of each finger;

means to secure said first tab to the medial side of the vamp and second means to secure the second tab to the lateral side of the vamp.

2. A boot as defined in claim 1 including chains with hooks attached to the eyes of said first and second tab.

3. A boot as defined in claim 1 in which the securing means are stitches of thread.

4. A boot as defined in claim 1 including tabs on the opposite sides of the quarter of the boot.

5. A tab for attaching to a boot to which chains may be attached which comprises:

a piece of shoe material, said shoe material having at least two parallel cuts through the material but not extending to the edges of the piece of material and another cut along a line extending the ends of said parallel cuts to form at least one finger which has one end still attached to the material and the other end free to move, and an eyelet in the other end of said finger.

6. A tab as defined in claim 5 in which there are at least three parallel cuts to form at least two fingers.

7. A tab for attaching to a boot to which chains may be attached which comprises:

a piece of shoe material comprising a single piece of material having cuts made therethrough but none to the periphery thereof for creating at least one finger and a corresponding finger surrounding portion in said tab, in which one end of the finger is integral with the material and the other end is movable with respect to the portion of the material surrounding the finger, and an eyelet in each such movable end.

* * * * *